US008769887B2

(12) United States Patent
Proffitt, Jr.

(10) Patent No.: US 8,769,887 B2
(45) Date of Patent: Jul. 8, 2014

(54) HOLD DOWN CLIP AND WALL SYSTEM

(76) Inventor: Ray A. Proffitt, Jr., Clinton, TN (US)

( * ) Notice: Subject to any disclaimer, the term of this patent is extended or adjusted under 35 U.S.C. 154(b) by 1938 days.

(21) Appl. No.: 11/873,022

(22) Filed: Oct. 16, 2007

(65) Prior Publication Data

US 2008/0086963 A1 Apr. 17, 2008

Related U.S. Application Data

(63) Continuation-in-part of application No. 11/463,073, filed on Aug. 8, 2006, now Pat. No. 8,234,826.

(60) Provisional application No. 60/804,889, filed on Jun. 15, 2006.

(51) Int. Cl.
*E04B 1/98* (2006.01)

(52) U.S. Cl.
USPC ..... 52/167.3; 52/695; 52/696; 52/655.1; 52/712

(58) Field of Classification Search
USPC ..... 52/695, 693, 696, 657, 655.1, 656.1, 52/653.1, 651.1, 167.3, 240, 712
See application file for complete search history.

(56) References Cited

U.S. PATENT DOCUMENTS 2,126,511 A * 8/1938 Soule ..... 52/223.6
4,192,118 A * 3/1980 Gilb ..... 52/714
4,665,672 A 5/1987 Commins
4,744,192 A 5/1988 Commins
4,825,621 A 5/1989 Jensen
5,092,097 A 3/1992 Young
5,249,404 A 10/1993 Leek et al.
5,467,570 A 11/1995 Leek
5,535,561 A 7/1996 Schuyler
5,979,130 A 11/1999 Gregg et al.
6,014,843 A 1/2000 Crumley et al.
6,065,267 A * 5/2000 Fisher ..... 52/692
6,067,769 A 5/2000 Hardy
6,112,495 A 9/2000 Gregg et al.
6,158,188 A * 12/2000 Shahnazarian ..... 52/702
6,185,898 B1 * 2/2001 Pratt ..... 52/657
6,195,949 B1 3/2001 Schuyler
6,250,041 B1 6/2001 Seccombe
6,298,630 B1 10/2001 VeRost et al.
6,311,449 B1 11/2001 Morse et al.
6,389,778 B1 * 5/2002 Strange ..... 52/745.19
6,453,634 B1 9/2002 Pryor
6,460,297 B1 10/2002 Bonds et al.
6,470,644 B2 10/2002 James et al.
6,560,940 B2 5/2003 Mueller
6,688,069 B2 2/2004 Zadeh
6,715,258 B1 4/2004 Mueller
6,843,027 B2 1/2005 Gaddie et al.
6,892,504 B1 * 5/2005 diGirolamo et al. ..... 52/657

(Continued)

*Primary Examiner* — Jessica Laux
(74) *Attorney, Agent, or Firm* — Luedeka Neely Group, PC

(57) ABSTRACT

A tensionable hold down clip system for erecting metal studs for building walls, the system including a tensionable member; and a hold down clip having a base portion, a leg portion orthogonal to the base portion, and a mount on the leg portion configured for adjustably connecting the tensionable member to the hold-down clip. A wall using the system may include two main studs and a plurality of common studs extending between a sole plate and a top plate, and hold down clips are disposed on both ends of both main studs. Two tensionable members extend diagonally through the studs and cross each other, and the tensionable members are fastened to mounts on the hold down clips on the upper and lower ends of the main studs.

6 Claims, 15 Drawing Sheets

(56) References Cited

U.S. PATENT DOCUMENTS

| | | | | |
|---|---|---|---|---|
| 7,014,383 | B2 | 3/2006 | Schmid | |
| 7,017,312 | B1 | 3/2006 | Mueller | |
| 7,299,596 | B2 * | 11/2007 | Hildreth | 52/695 |
| 2002/0062617 | A1 | 5/2002 | diGirolamo et al. | |
| 2003/0066250 | A1 | 4/2003 | Moore | |
| 2004/0065032 | A1 | 4/2004 | Commins | |
| 2004/0068947 | A1 | 4/2004 | Commins et al. | |
| 2005/0284057 | A1 | 12/2005 | Commins | |
| 2006/0032180 | A1 | 2/2006 | Peterson | |
| 2007/0107338 | A1 | 5/2007 | Daudet | |

* cited by examiner

HOLD DOWN CLIP AND WALL SYSTEM

CROSS-REFERENCE TO RELATED APPLICATION

This application is a continuation-in-part of U.S. application Ser. No. 11/463,073 filed Aug. 8, 2006, and entitled HOLD DOWN CLIP, which claims priority to U.S. Provisional Application Ser. No. 60/804,889, filed on Jun. 15, 2006, and entitled HOLD DOWN CLIP.

FIELD

This disclosure relates to the field of structural connectors and to wall structures. More particularly, this disclosure relates to hold down devices which incorporate tensioning members and to wall systems having the hold down devices and tensioning members.

BACKGROUND

Hold down clips are used to anchor structural members to the foundation and/or to one another. Such anchoring and interconnection can add stability and improve the structural capacity of the building structure. However, current hold down clips are cumbersome to handle and install, and often require more than one person to effect assembly to an adjacent hold down clip. Accordingly, there is a need for improved hold down clips for assembling metal studs for building walls.

Embodiments of the disclosure provide a stud wall assembly structure that includes an elongate tensionable member; a metal stud including an aperture therethrough for passage of the tensionable member; and a hold down structure attached to the metal stud.

The hold down structure includes a base portion, a leg portion orthogonal to the base portion, a reinforcing flange attached to the leg portion and base portion, a connecting bolt disposed in a slotted aperture in the base portion. The hold down structure contains a plurality of bolt holes for attaching the leg portion to the metal stud; and a mount on the leg portion configured for adjustably connecting the tensionable member to the hold-down structure.

Another embodiment of the disclosure provides a tensionable hold down clip system for erecting metal studs for building walls. The system includes a tensionable member and a hold down clip. The clip includes a base portion, a leg portion orthogonal to the base portion, and a mount on the leg portion configured for adjustably connecting the tensionable member to the hold-down clip.

Yet another embodiment of the disclosure provides a method for building walls using the clips and the tensionable members.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

FIGS. 1-9

Figure 1:
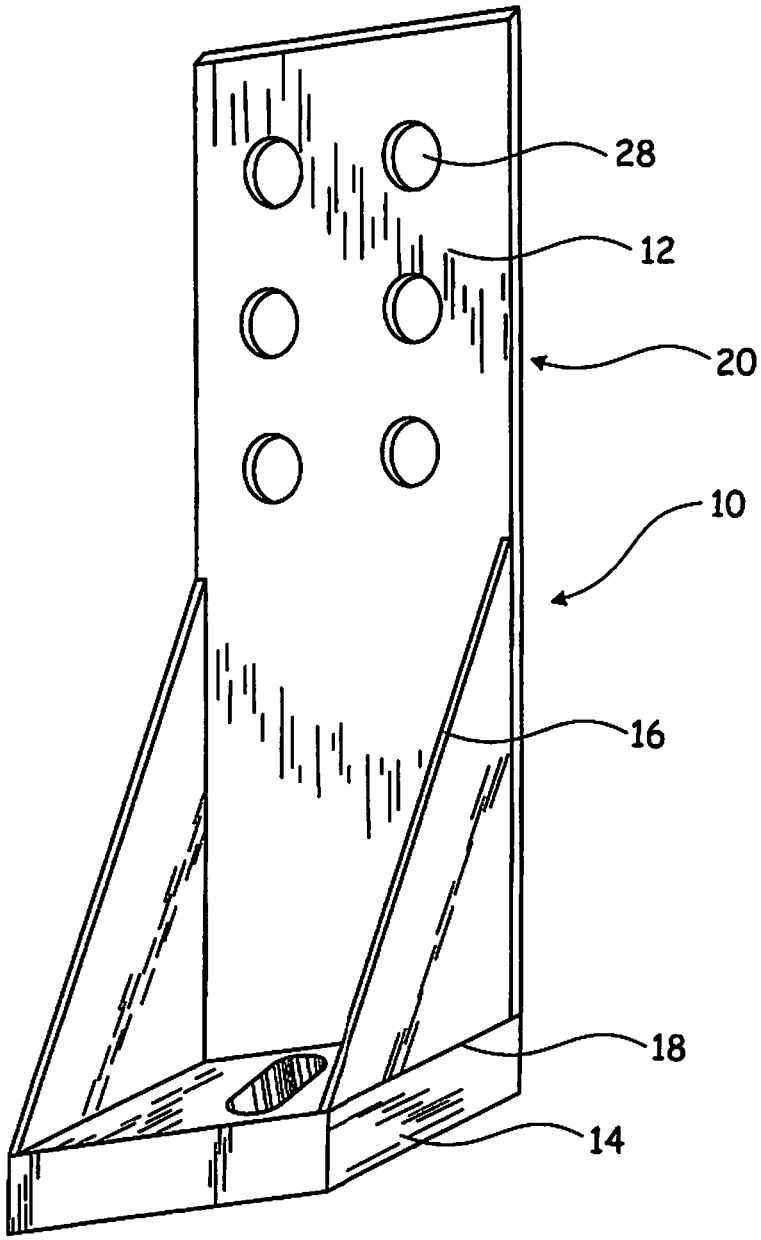
FIG. 1 is a perspective view of a hold down clip according to an exemplary embodiment of the disclosure.

With reference to FIGS. 1-9, one aspect of the disclosure relates to an improved hold down clip 10 (FIG. 1). The clip 10 is generally an L-shaped structure that includes a leg portion 12, a substantially perpendicular base portion 14, and one or more reinforcing flanges 16 which are attached to the leg portion 12 and the base portion 14. The clip 10 is preferably made of welded steel construction.

For the purpose of example, the leg portion 12 may have a thickness of about 3/16 inch, a width of about 3 inches, and a length of about 11 inches. The base portion 14 may have a thickness of about ¾ inch, a width of about 2½ inches, and a length of about 3½ inches. The one or more flanges 16 may each have a thickness of about ¼ inch and configured to be secured to edges 18 of the base portion 14 and edges 20 of the leg portion 12. The one or more reinforcing flanges 16 may have a length L that ranges from about 3 to about 6 inches.

Unlike conventional hold down clips, the clip 10 advantageously uses bolts 22 (FIG. 2) for attaching the clip 10 to a metal stud 24 and an associated support 26 oriented generally orthogonal to the stud 24. The bolts 22 are passed through apertures 28 (FIG. 1) in the leg portion 12 of the clip 10. The apertures 28 are aligned with corresponding apertures 30 (FIG. 3) defined through the metal stud 24. The bolts 22 are secured by use of nuts 32 threaded onto free end of the bolts 22. Conventional circular washers 34 are typically used with the nuts 32. The apertures 30 may be formed as by drilling through the metal studs 24 using the apertures 28 in the clip 10 as a guide. The apertures may be formed at the time of installation of the clip 10 to the stud 24 to enable custom fitting of the clip 10 to the stud 24.

Conventional hold down clips utilize a large number of small machine screws to secure a hold down clip to a metal stud. Installing the large number of machine screws is time consuming and may not provide the stability that the bolts 22 provide. The use of a substantially fewer number of larger bolts 22 speeds up attachment time and offers improved strength. For example, a hold down clip having a leg portion 12 length of about 14 inches may have 24 machine screws and a leg portion 12 length of about 21.5 inches may have 48 machine screws. By contrast, only from about 4 to about 8 of the bolts 22, or about one fourth to about one sixth as many bolts 22 are used for the leg portion 12 of the clip 10 according to the disclosure as compared to the number of machine screws that would be used for a conventional hold down clip.

Figure 2:
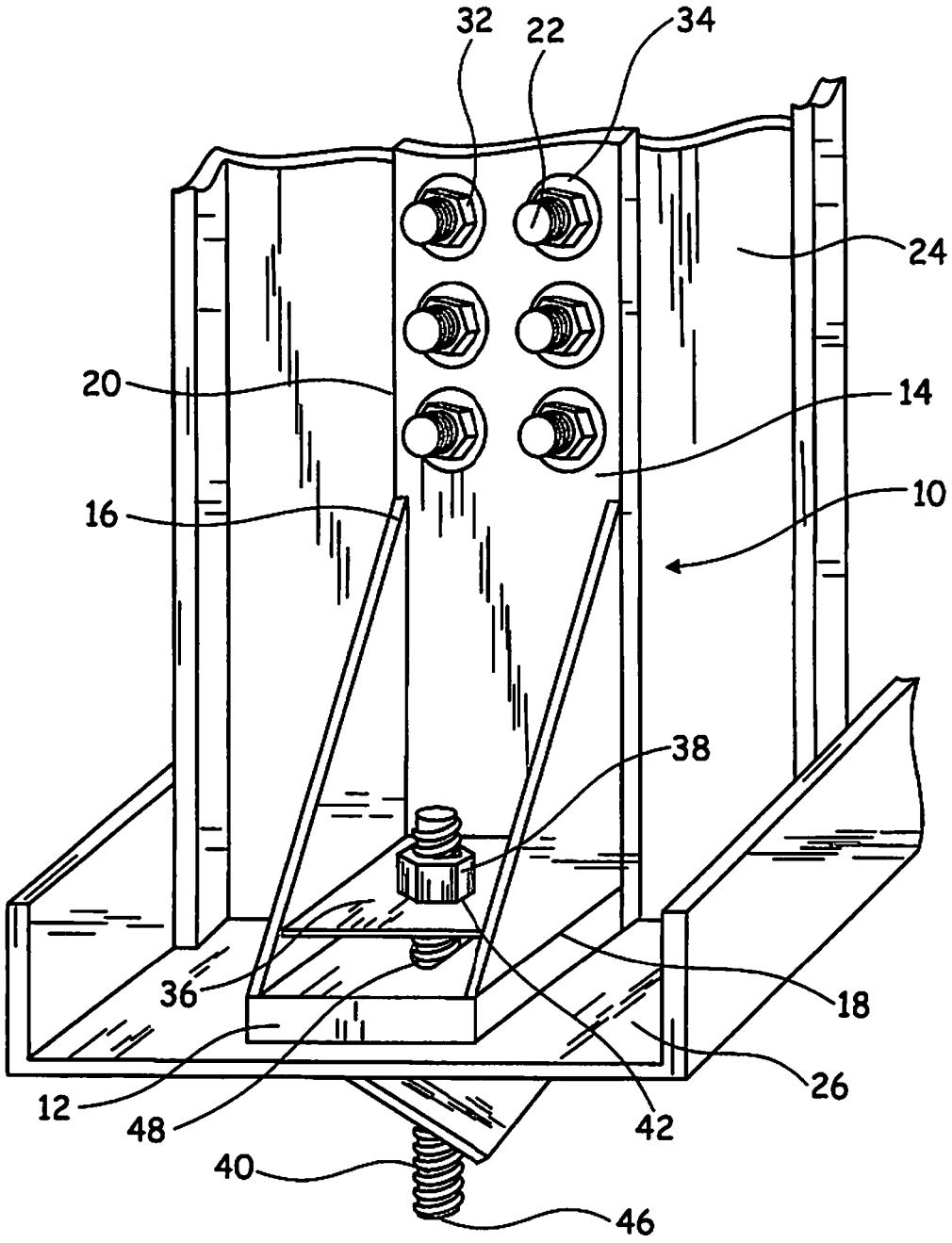
FIG. 2 is a top perspective view of a hold down clip attached to a metal stud and base according to an embodiment of the disclosure.
Figure 3:
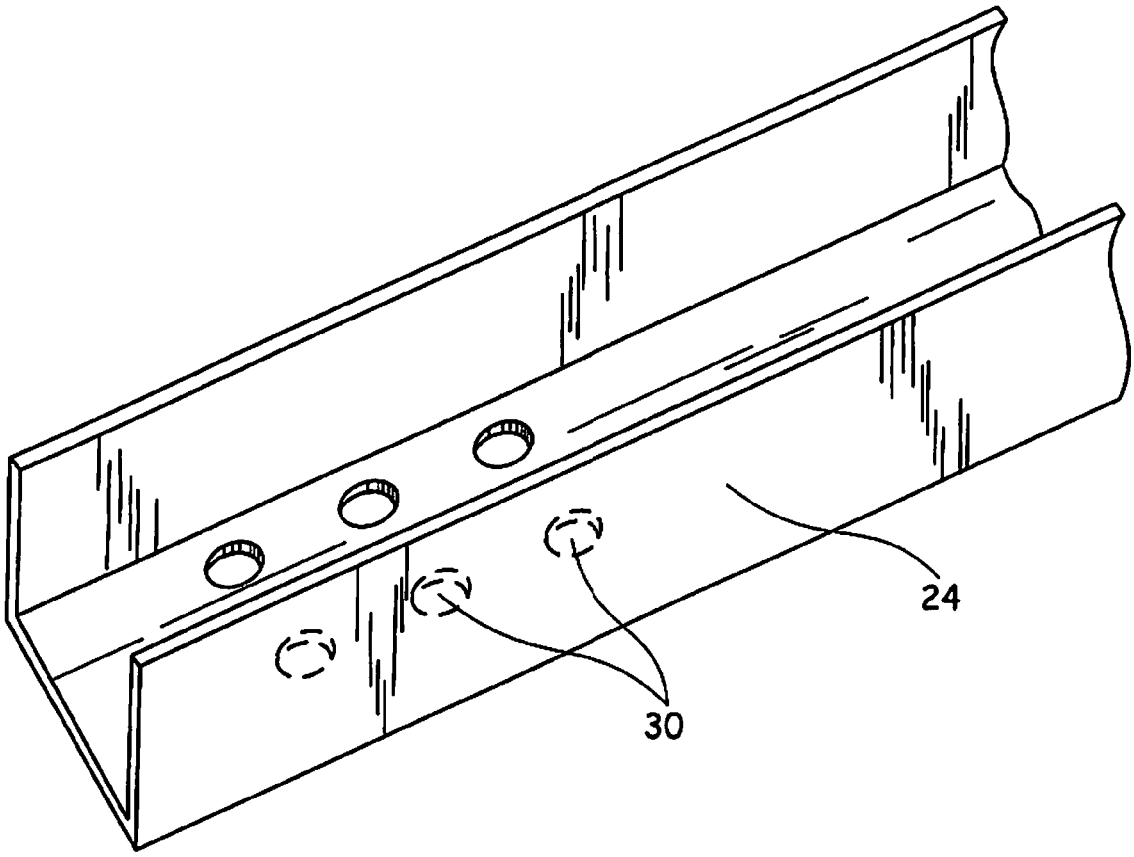
FIG. 3 is a perspective view of a metal stud for use with the hold down clip according to the disclosure.
Figure 4:
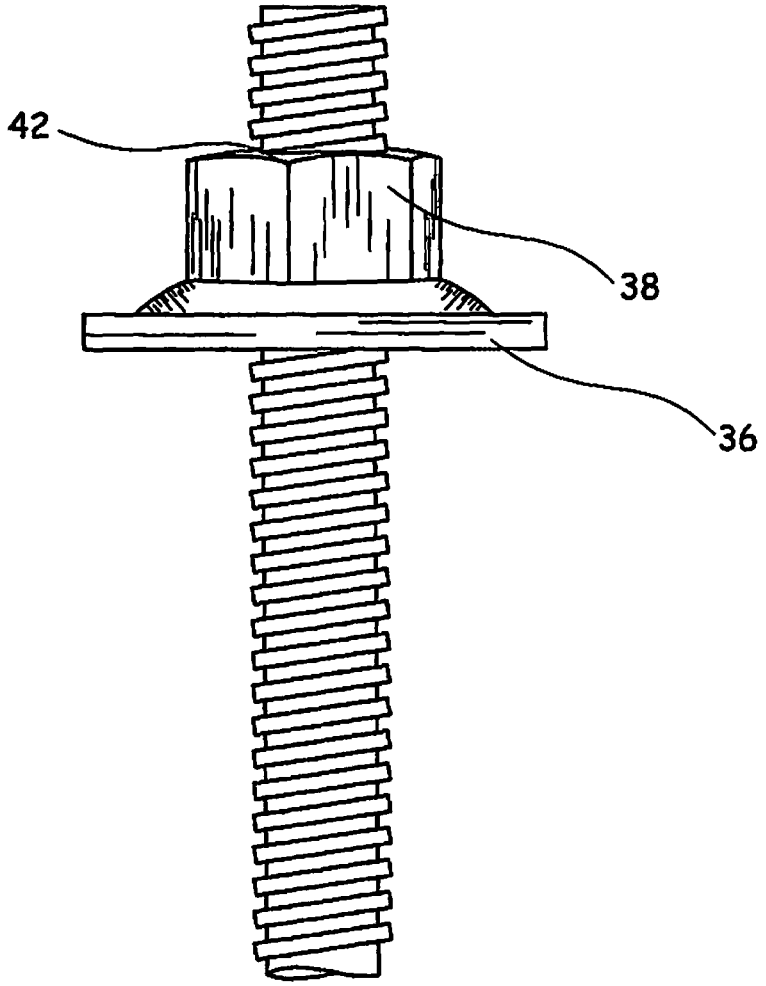
FIG. 4 is an enlarged perspective view of a bolt and fixedly attached washer and nut for a hold down clip according to the disclosure.
Figure 5:
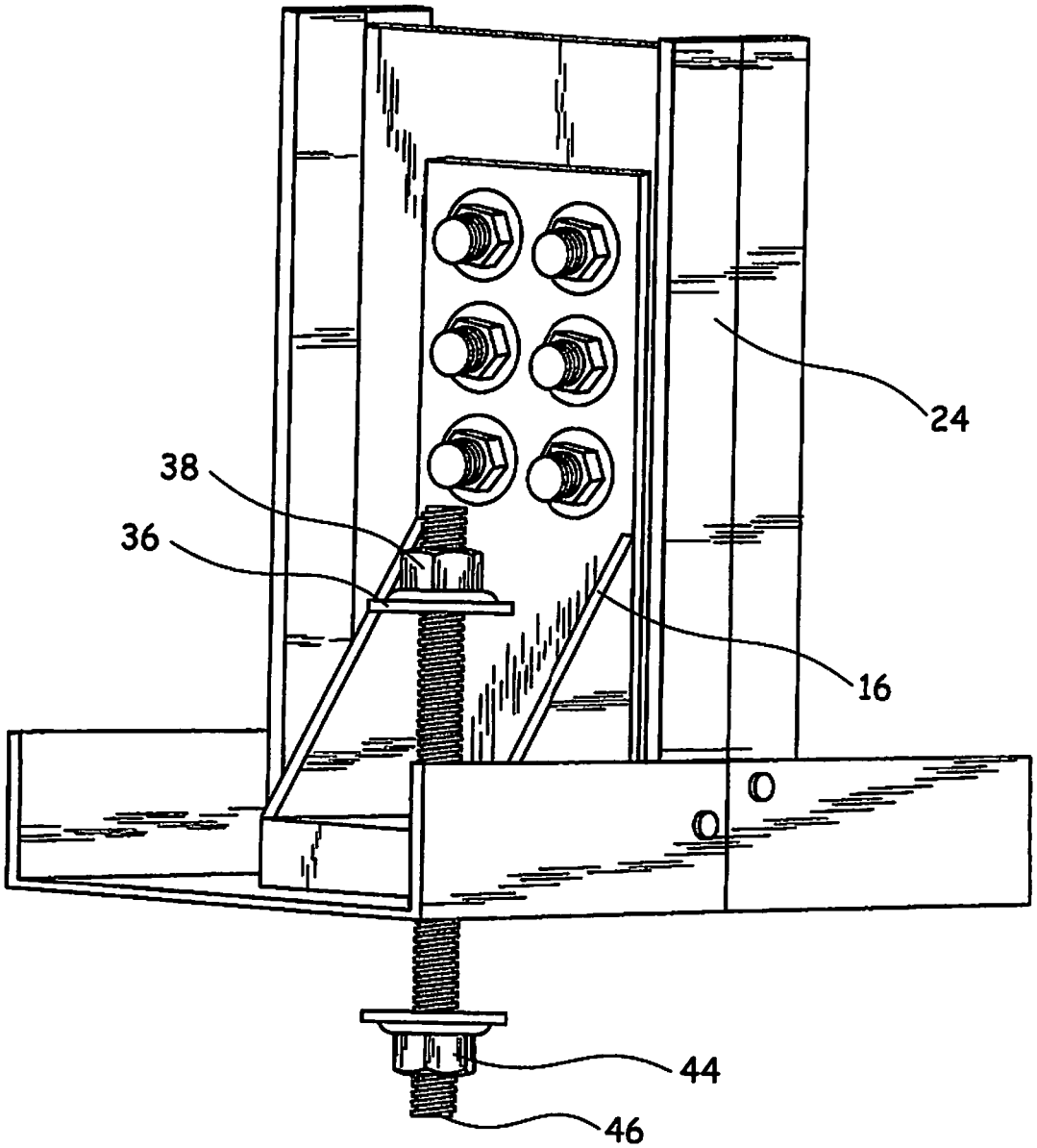
FIG. 5 is a side perspective view of a hold down clip attached to a metal stud and base according to the disclosure.
Figure 6:
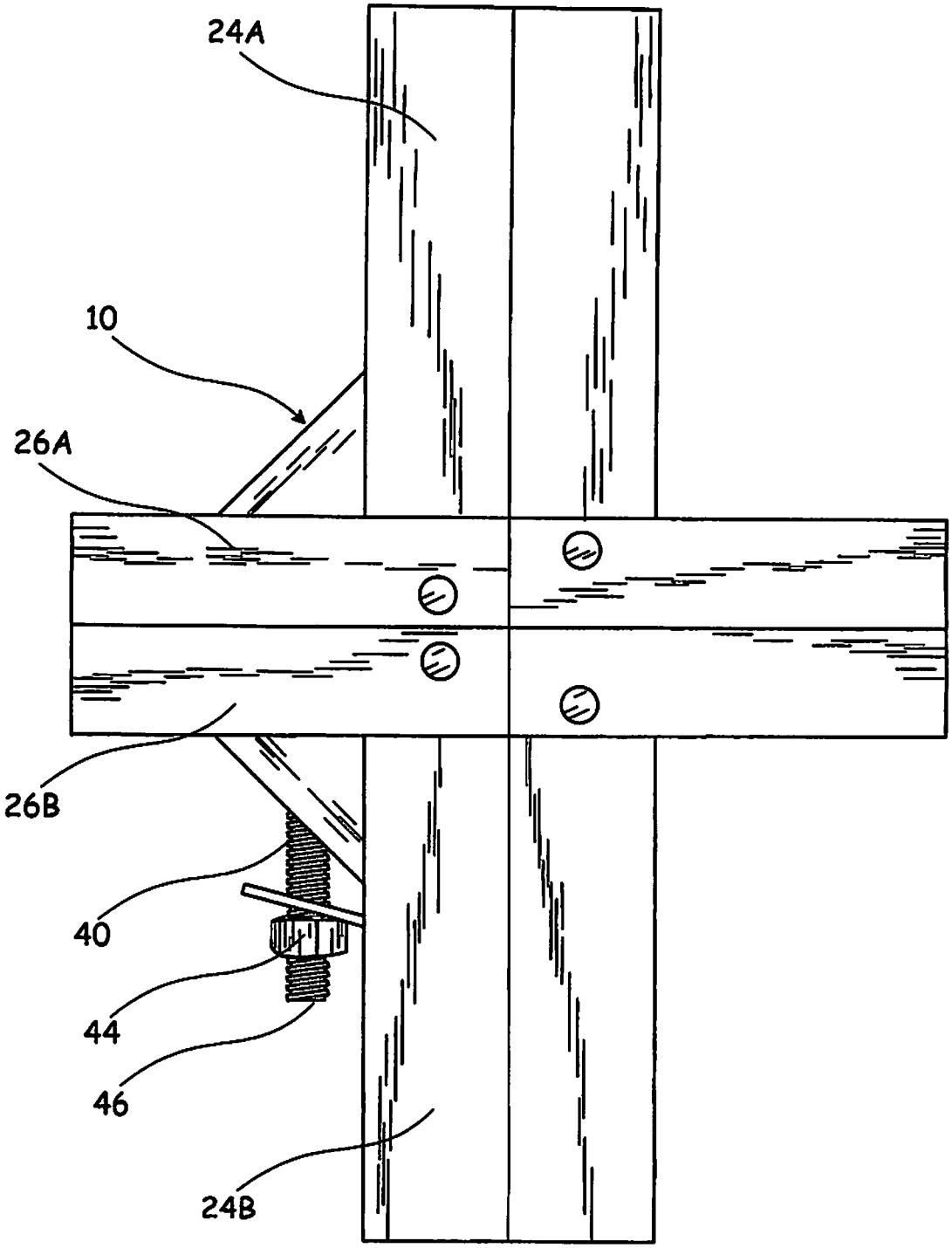
FIG. 6 is an illustration of use of a hold down clip according to the disclosure used to attach adjacent metal studs and supports to one another.

With additional reference to FIG. 2, another aspect of the disclosure relates to the use of an angular, and preferably square or rectangular, washer 36 integrated with a nut 38 (preferably secured together as by welding). The nut 38 is fixedly attached to a hold down bolt 40, as by welds 42 as shown in more detail in FIG. 4. The washer 36 cooperates with the one or more flanges 16 to enable a nut 44 on a distal end 46 of the bolt 40 (FIG. 5) to be tightened by a single user. For example, the washer 36 may be captured between spaced apart flanges 16 to prevent rotation of the fixedly attached bolt 40 while the nut 44 is being adjusted along the bolt 40. The foregoing washer 36 and nut 38 are particularly useful in assembling adjacent metal studs 24A and 24B to one another to provide a multi-story building structure as illustrated in FIG. 6 as described in more detail below.

Figure 7:
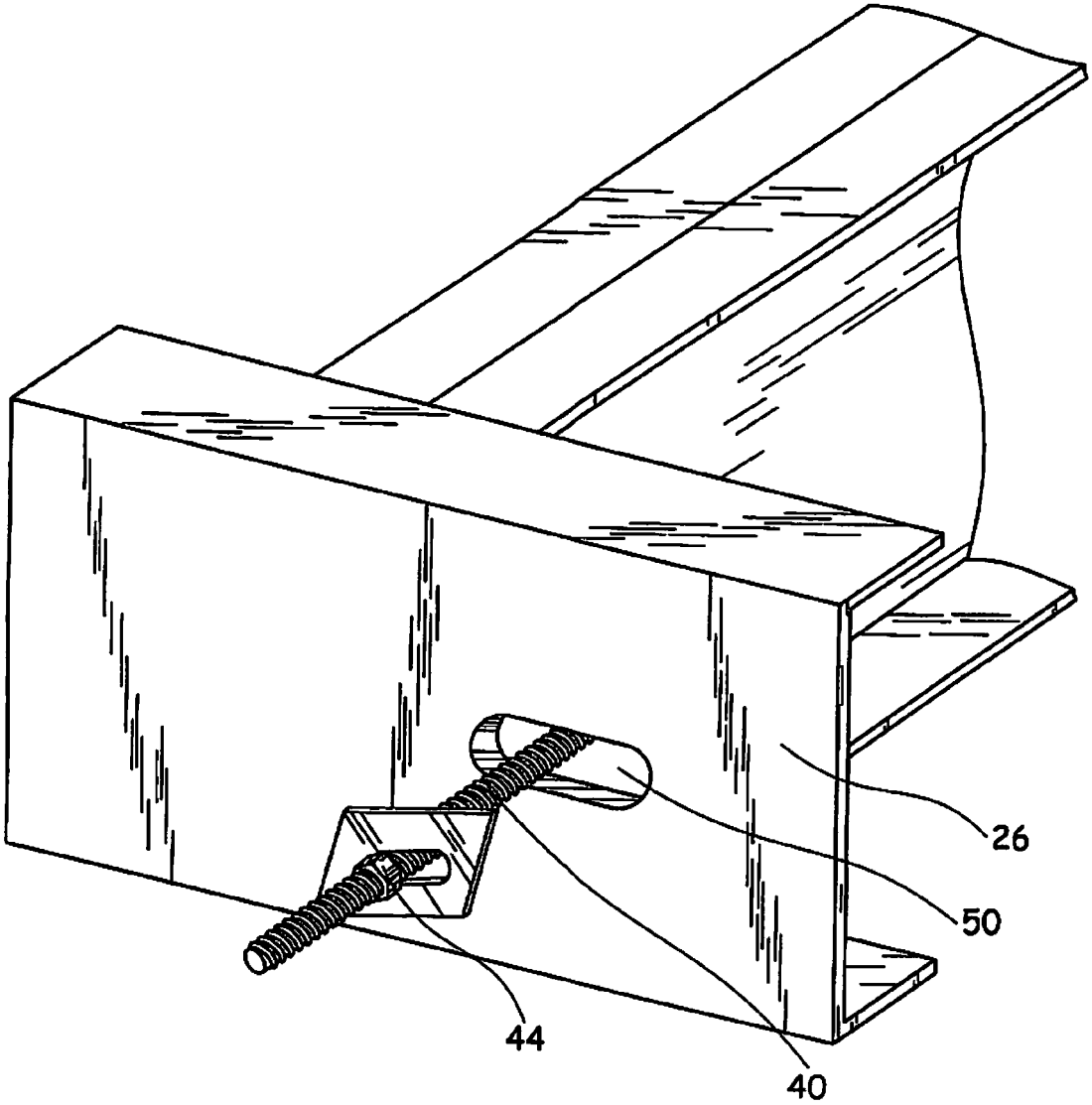
FIG. 7 is a top perspective view of a slot in a base portion of a hold down clip according to the disclosure.
Figure 8:
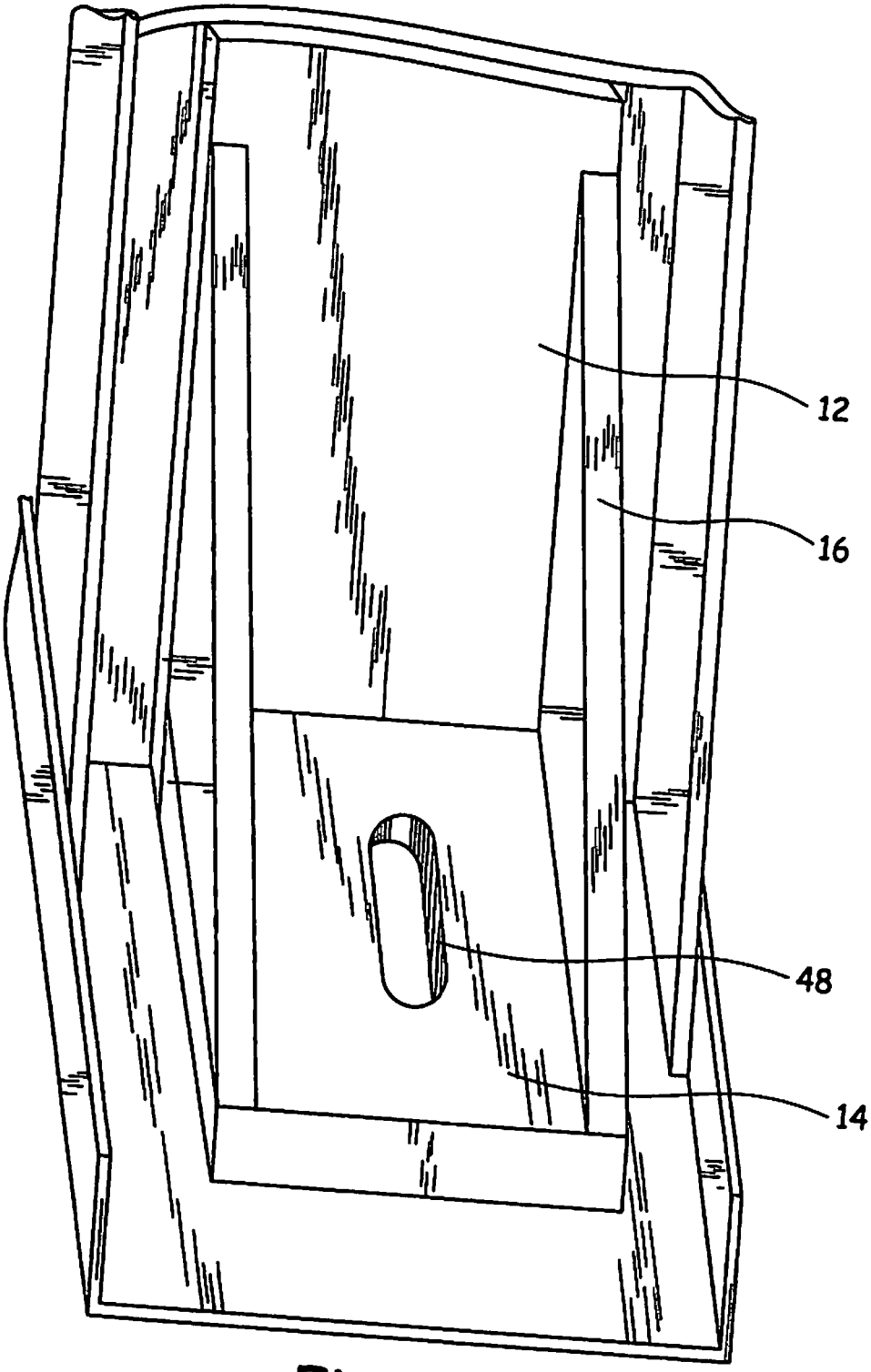
FIG. 8 is a bottom perspective view of a slot in a metal support for a stud wall.

Another advantage of the clip 10 according to the disclosure relates to the provision of an elongate slot 48 in the base portion 14 thereof as illustrated more clearly in FIG. 7. The elongate slot 48 is aligned with an elongate slot 50 in the support 26 as shown in FIG. 8. The elongate slot 48 typically has a length dimension of about 3½ inches and a width dimension of about 1½ inches. However, it is desirable that the slot 48 in the base portion 12 be configured to be just slightly smaller, e.g., about ¼ inch, in each dimension than the slot 50 in the support 26. The slots 48 and 50 enable adjacent ones of the hold down clips 10 to interconnect with one another as illustrated in FIG. 6. As shown in FIG. 6, even if the studs 24A and 24B are corresponding supports 26A and 26B are mis-aligned, the slot 48 and the corresponding slot 50 in the support 26 enable interconnection of the two assemblies.

Figure 9:
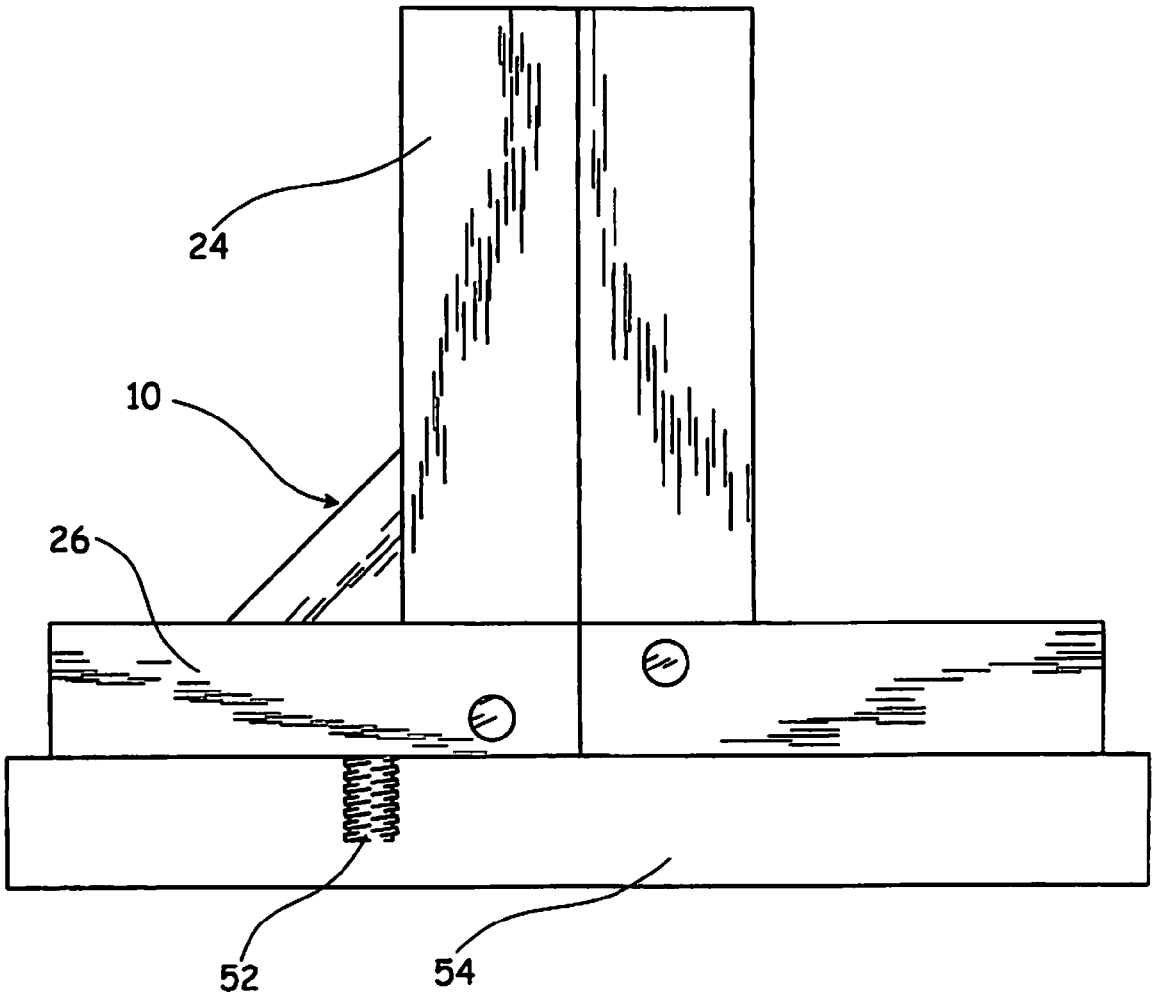
FIG. 9 is an illustration of use of a hold down clip according to the disclosure to attach a metal stud and base to a foundation.

The clip 10 may also be used with an anchor bolt 52 for attaching the clip 10 and support 26 to a floor, concrete slab, or other foundation 54 as illustrated in FIG. 9. Accordingly, the slot 48 and the slot 50 enable alignment of the studs 24 with the anchor bolt 52.

FIGS. 10-15

With reference to FIGS. 10-14, another aspect of the disclosure relates to a hold down clip 10' (FIGS. 12-13) that incorporates a tensioning member 60, and to a wall system 62 constructed utilizing a plurality of the clips 10'.

The clip 10' is substantially identical to the clip 10, except that it includes a mount 64 on the leg portion 12 thereof configured for adjustably connecting the tensioning member 60 to the clip 10'. The mount 64 is preferably provided as by a slot 66 that extends from a back-side 68 of the leg portion 12 to a front-side 70 of the leg portion 12, and a surrounding and at least partially convex surface 72. The combination of the slot 66 and the convexity of the surface 72 enables at least some degree of adjustability of the tensioning member 60, as described in more detail below.

Figure 10:
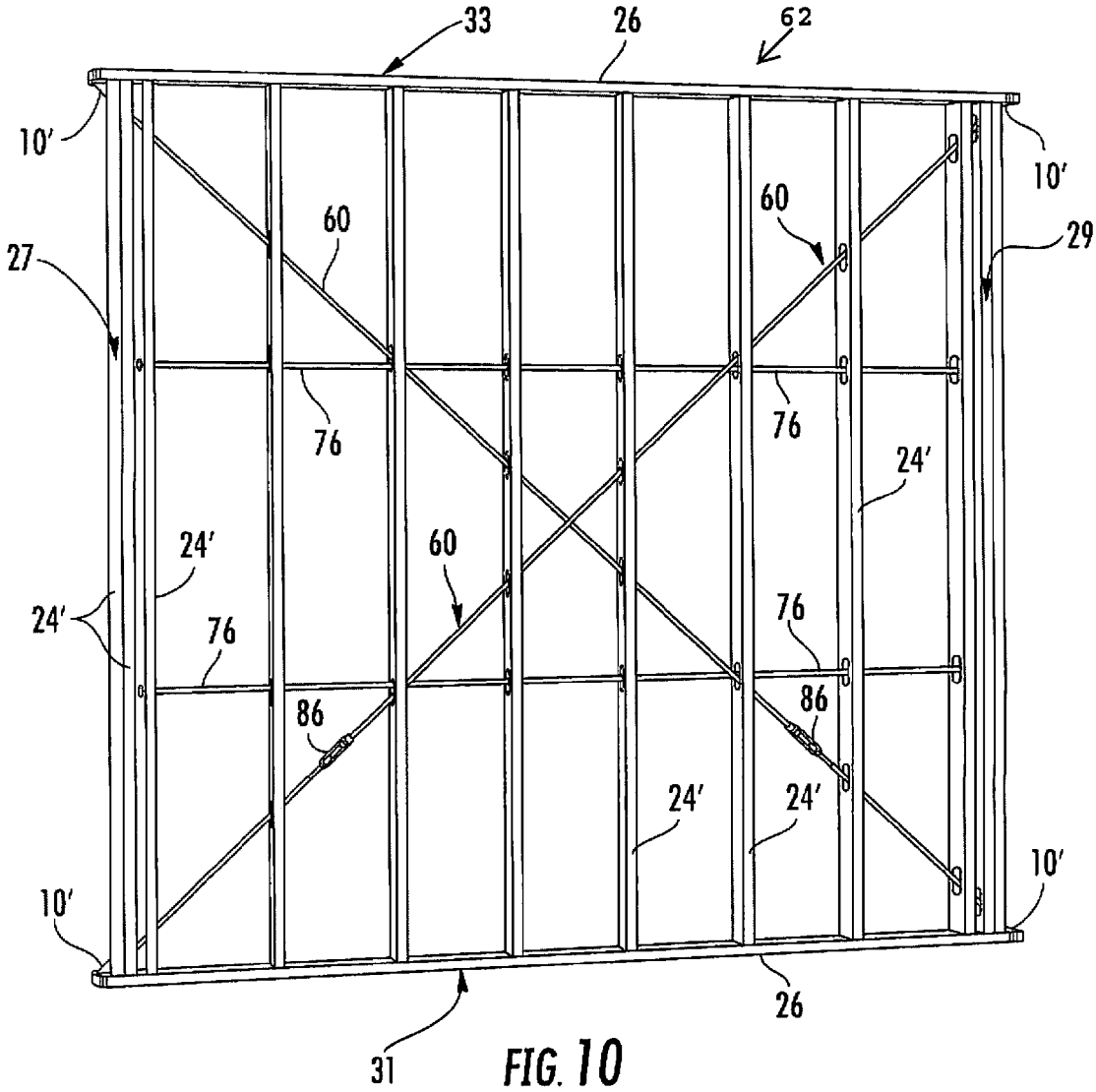
FIGS. 10 and 11 show a wall system according to an alternate embodiment of the disclosure.
Figure 11:
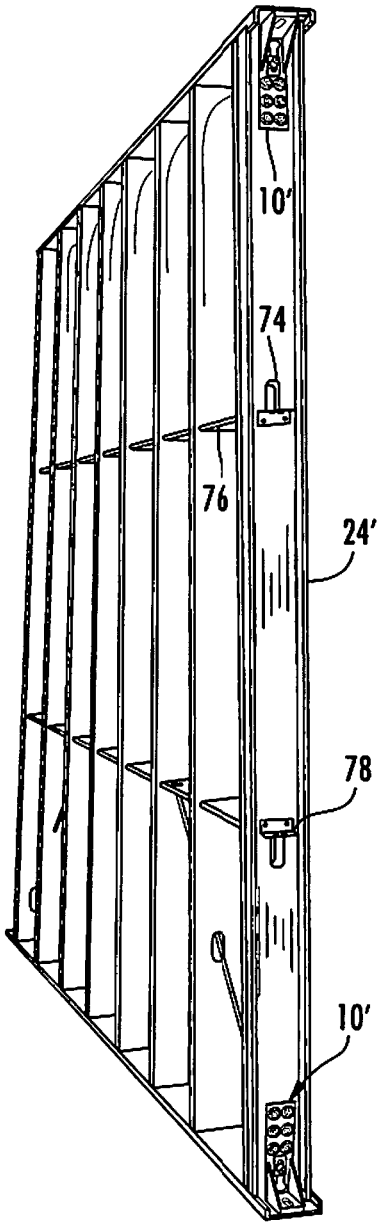
Figure 12:
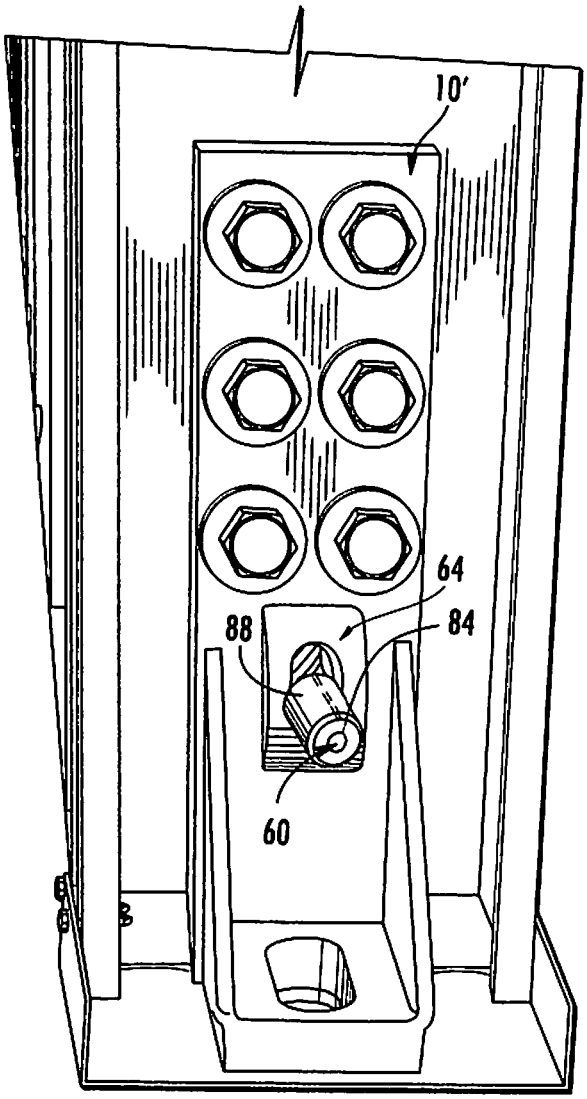
FIGS. 12 and 13 show a hold down clip according to an alternate embodiment that is utilized in the wall system of FIGS. 10 and 11.
Figure 13:
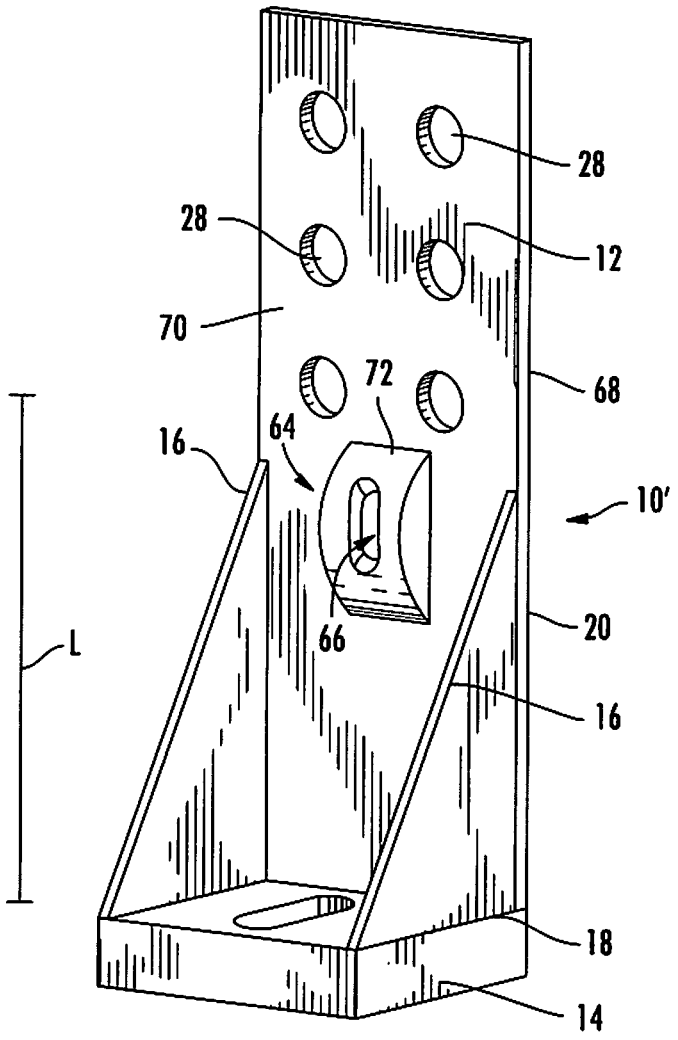
Figure 14:
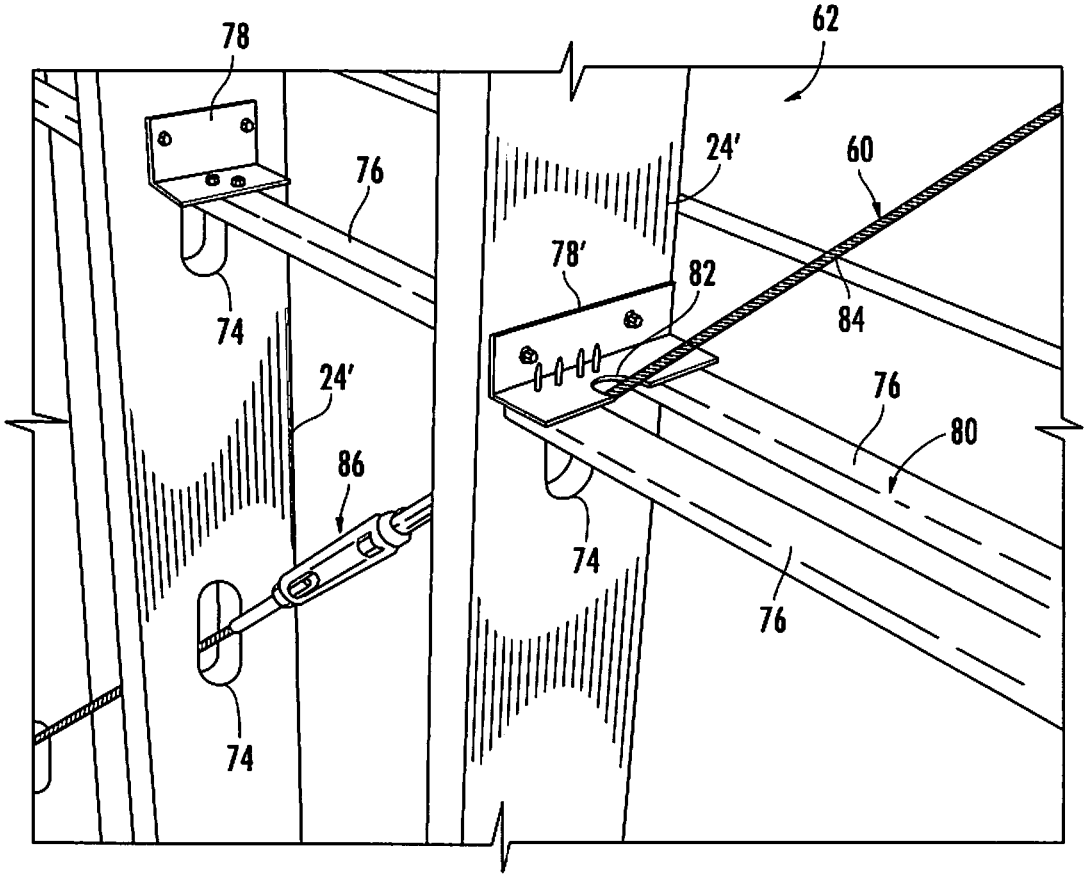
FIG. 14 is a close-up view of a portion of the wall system of FIGS. 10 and 11.

The wall system 62 includes a plurality of metal studs 24' and tracks or supports or plates 26'. As shown in FIG. 10 the studs 27 and 29 on the left and right sides of the wall structure are double studs and may be referred to as main studs 27 and 29. The plate 26 on the top of the wall structure may be referred to has the top plate 33 and the plate 26 on the bottom may be referred to as the bottom plate 31. The supports 26' correspond to the supports 26. With particular reference to FIG. 14, the studs 24' correspond to the studs 24, except the studs 24' include apertures 74 defined therethrough for passage of the tensioning members 60. Additionally, a reinforcing member 76, such as a length of metal strip having a U-shaped cross section (which is also referred to a channel or a channel brace), is secured to laterally span between adjacent ones of the studs 24. The reinforcing members 76 are secured as by braces 78, such as L-shaped sheets of metal, attached to the studs 24' and the reinforcing members 76 as by sheet metal screws.

With additional reference to FIG. 14, it will be seen that a single one of the reinforcing members 76 is provided between the studs 24' at locations through which one of the tensioning members 60 does not extend, with the member 76 generally centered on the studs 24'. However, proximate locations where one of the tensioning members 60 extends, such as adjacent one of the apertures 74 through which the member 60 extends, a pair of the reinforcing members 76 are provided, and spaced apart to provide a gap 80 for passage of the member 60. Additionally, the braces 78 adjacent such locations are replaced by braces 78' which include a cutout 82 for providing clearance for passage of the member 60.

The tensioning members 60 are provided by elongate tensionable structures such as elongate cables 84 joined together by turnbuckles 86 connected to the cables 84 in the assembled wall structure to impart additional cross-bracing of the structure. The turnbuckles 86 may be manipulated to impart a desired tension to the cables 84. The ends of the cables 84 proximate the clips 10' include a button or stop 88 securely fastened to the cable 84 and dimensioned so as to contact the convex surface 72 and not pass through the slot 66. In this regard, the stop 88 also engages the surface 72 so as to maintain the cable 84 in a relatively linear orientation so as to avoid kinking of the cable 84. That is, the convex surface 72 provides a plurality of different angles so that when the stop 88 bears against the surface 72 when the cable 84 or other tensionable structure is tensioned, the stop 88 will move to a location that substantially maintains the cable 84 in a linear orientation to avoid kinking.

Figure 15:
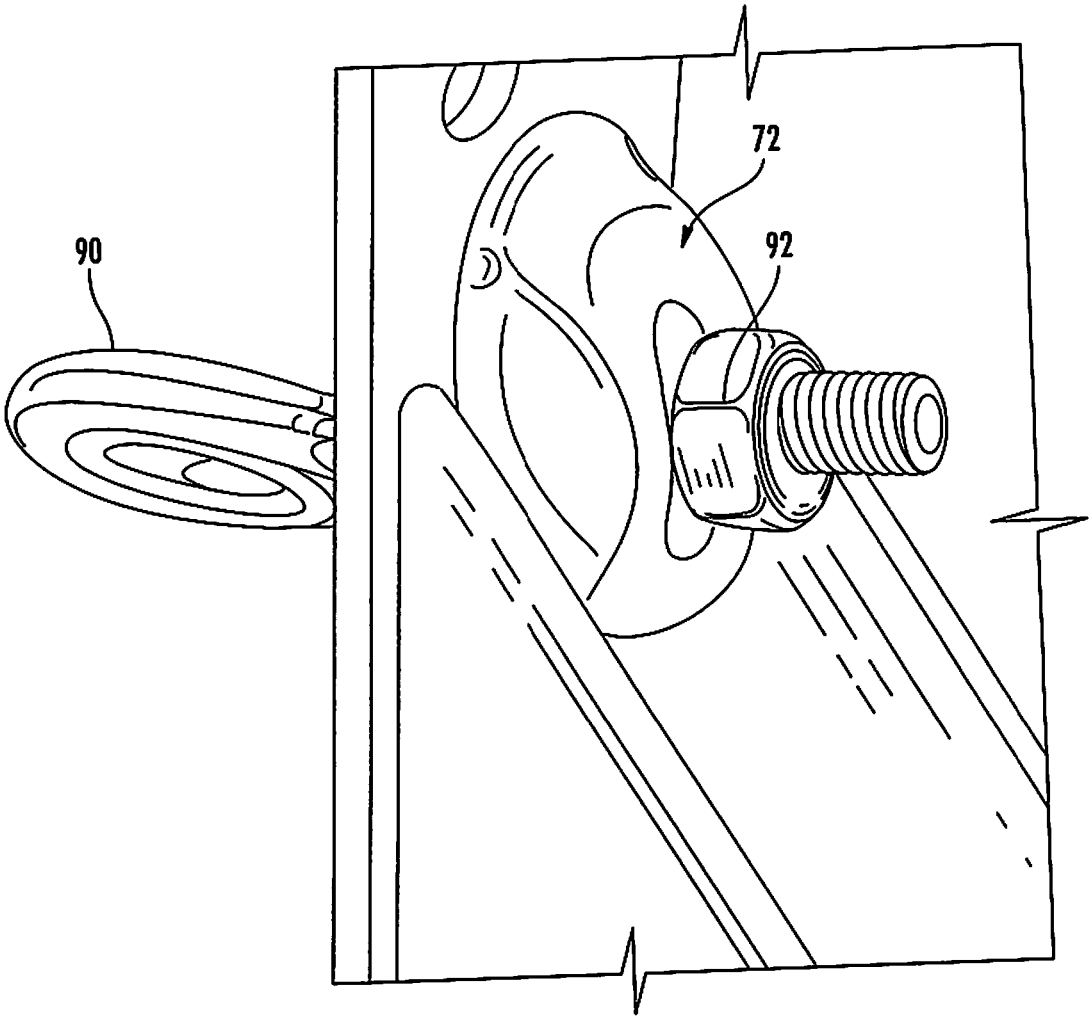
FIG. 15 shows an alternate embodiment of linking a tensioning member to the clip.

With reference to FIG. 15, alternative structure may be provided to link the cable 84 to the clip and provide the stop 88, such as by providing an eye-bolt 90 to which the cable 84 is attached, with the threaded bolt end extending through the slot 66 and a nut 92 threaded thereon to contact the surface 72 in the manner of the stop 88 to allow the bolt 90 to move so that the cable 84 attached to the eye bolt 90 may be maintained in a relatively linear orientation to avoid kinking of the cable.

As seen in FIG. 10, the wall system 62 may be constructed by disposing the track or support 26 along a floor, concrete slab, or other foundation (including an underlying wall structure) and securing it thereto using the clips 10', in the manner previously described for the clips 10. The studs 24' are then erected to extend upwardly from the support 26, as by securing the studs 24' to the support 26 using metal fasteners, with the studs 24' being doubled adjacent the ends. Another support 26 is installed at the top of the studs 24' in a similar manner, and the reinforcing members 76 installed using the braces 78 and 78'. The tensioning members 60 are then installed and tensioned as by use of the turnbuckles 86. As will be appreciated, the structure advantageously enables location of all components of the tensioning members 60 within a plane parallel to the plane of the wall system 62 and proximate the midpoint of the wall system. That is, generally proximate the center of the width axis of the metal studs. As will be appreciated, this advantageously maintains the tensioning forces relatively proximate the center of the wall.

It is contemplated, and will be apparent to those skilled in the art from the preceding description and the accompanying drawings that modifications and/or changes may be made in the embodiments of the disclosure. Accordingly, it is expressly intended that the foregoing description and the accompanying drawings are illustrative of exemplary embodiments only, not limiting thereto, and that the true spirit and scope of the present disclosure be determined by reference to the appended claims.

What is claimed is:

1. A stud wall assembly structure comprising:

an elongate tensionable member;

a metal stud including an aperture therethrough for passage of the tensionable member; and a hold down structure attached to the metal stud, the hold down structure comprising a base portion, a leg portion having a length orthogonal to the base portion, a reinforcing flange attached to the leg portion and base portion, a connecting bolt disposed in a slotted aperture in the base portion, wherein the hold down structure contains a plurality of bolt holes for attaching the leg portion to the metal stud; and a mount on the leg portion configured for adjustably connecting the tensionable member to the hold-down structure, the mount comprising an elongate slot that extends from a back-side of the leg portion to an opposite front-side of the leg portion and having its length oriented substantially aligned with the length axis of the leg portion, and including a surrounding and at least partially convex surface, wherein the slot and the convexity of the surface enables adjustment of the orientation of the tensionable member.

2. The stud wall assembly structure of claim 1, wherein the tensionable member comprises a cable and a turnbuckle.

3. The stud wall assembly structure of claim 1, wherein the tensionable member includes a stop positionable for contacting the at least partially convex surface.

4. A tensionable hold down clip system for erecting metal studs for building walls, the system comprising: a tensionable member; and a hold down clip comprising: a base portion, a leg portion having a length orthogonal to the base portion, and a mount on the leg portion configured for adjustably connecting the tensionable member to the hold-down clip, the mount comprising an elongate slot that extends from a back-side of the leg portion to an opposite front-side of the leg portion and having its length oriented substantially aligned with the length axis of the leg portion, and including a surrounding and at least partially convex surface, wherein the slot and the convexity of the surface enables adjustment of the orientation of the tensionable member.

5. The system of claim 4, wherein the tensionable member comprises a cable and a turnbuckle.

6. The system of claim 4, wherein the tensionable member includes a stop positionable for contacting the convex surface.

* * * * *